US010538082B2

(12) United States Patent
Fujii

(10) Patent No.: US 10,538,082 B2
(45) Date of Patent: Jan. 21, 2020

(54) SEMICONDUCTOR DEVICE, LIQUID DISCHARGE HEAD, AND LIQUID DISCHARGE APPARATUS

(71) Applicant: CANON KABUSHIKI KAISHA, Tokyo (JP)

(72) Inventor: Kazunari Fujii, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/994,186

(22) Filed: May 31, 2018

(65) Prior Publication Data

US 2018/0361737 A1 Dec. 20, 2018

(30) Foreign Application Priority Data

Jun. 15, 2017 (JP) ..... 2017-117888

(51) Int. Cl.
*B41J 2/045* (2006.01)
*B41J 2/14* (2006.01)

(52) U.S. Cl.
CPC ..... *B41J 2/04538* (2013.01); *B41J 2/0458* (2013.01); *B41J 2/04541* (2013.01); *B41J 2/04565* (2013.01); *B41J 2/14129* (2013.01); *B41J 2/14153* (2013.01)

(58) Field of Classification Search
CPC B41J 2/04538; B41J 2/04565; B41J 2/14153; B41J 2/14129; B41J 2/04541; B41J 2/0458
See application file for complete search history.

(56) References Cited

U.S. PATENT DOCUMENTS

| | | | | |
|---|---|---|---|---|
| 7,287,847 | B2 | 10/2007 | Fujii et al. | |
| 7,344,218 | B2 * | 3/2008 | Imanaka | B41J 2/04538 347/10 |
| 8,439,477 | B2 | 5/2013 | Markham et al. | |
| 8,562,111 | B2 | 10/2013 | Fujii | |
| 8,807,708 | B2 | 8/2014 | Fujii | |
| 9,085,135 | B2 | 7/2015 | Fujii et al. | |
| 9,205,649 | B1 | 12/2015 | Endo et al. | |
| 9,694,575 | B2 | 7/2017 | Fujii et al. | |

* cited by examiner

*Primary Examiner* — Sharon A. Polk
(74) *Attorney, Agent, or Firm* — Venable LLP

(57) ABSTRACT

A semiconductor device used for a liquid discharge head includes first heaters configured to apply energy to a liquid, second heaters whose resistance values are to be measured, switch elements, and first and second lines. Each of the second heaters is connected in series with a corresponding one of the switch elements between the first line and the second line. The second heaters have shapes different in at least one of length or width. A connection destination of at least one of two terminals of each of the first heaters is different from connection destinations of two terminals of each of the second heaters.

18 Claims, 7 Drawing Sheets

FIG. 6A
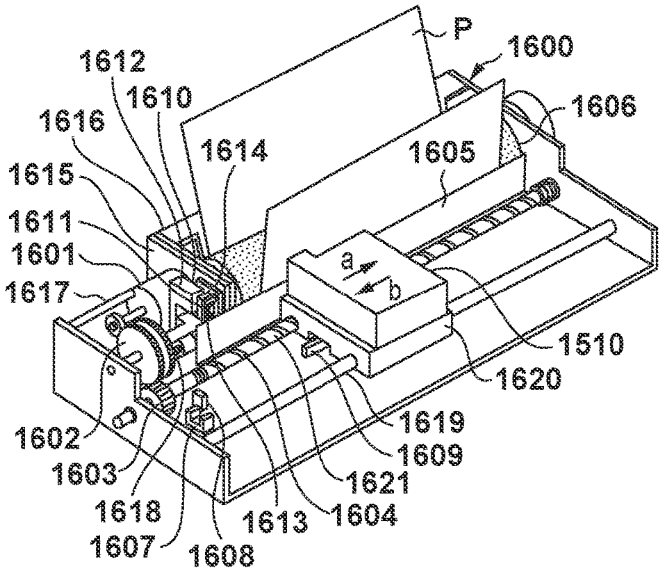
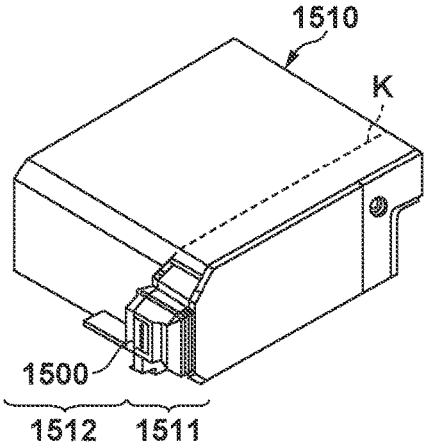
FIG. 6B
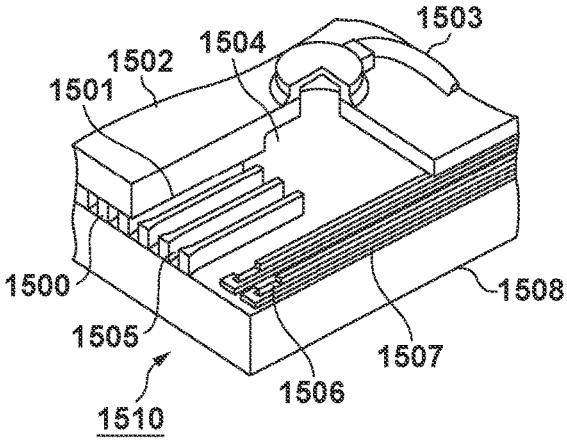
FIG. 6C

SEMICONDUCTOR DEVICE, LIQUID DISCHARGE HEAD, AND LIQUID DISCHARGE APPARATUS

BACKGROUND OF THE INVENTION

Field of the Invention

The present invention relates to a semiconductor device, a liquid discharge head, and a liquid discharge apparatus.

Description of the Related Art

In a liquid discharge head, in order to implement an increase in printing accuracy, it is desirable to accurately control a discharge ink amount defined by a thermal energy amount generated in a heater. On the other hand, there is a variation in the manufacture in the shapes of heaters that discharge ink. This causes a variation in energy to discharge ink, making it difficult to increase the printing accuracy. In U.S. Pat. No. 8,439,477, an error in size of a discharge heater for discharging ink is estimated by arranging a test heater different in size from the discharge heater near the end portion of a one-dimensional array of the discharge heater and computing the resistance values of the respective heaters.

SUMMARY OF THE INVENTION

In U.S. Pat. No. 8,439,477, a test heater is arranged only near the end portion of a one-dimensional array of a discharge heater, assuming that the sheet resistance value of a heater is constant regardless of the position in a semiconductor device. However, the sheet resistance value of the heater may have a variation depending on the position in the semiconductor device. It is therefore considered that a test heater is arranged at various positions of a substrate. However, the test heater in U.S. Pat. No. 8,439,477 is short-circuited to a pad to which an external apparatus is connected in order to measure the resistance value of the heater. Therefore, if the number of test heaters is increased, the number of pads and the number of lines are increased, leading to upsizing of the semiconductor device. One aspect of the present invention improves discharge accuracy while suppressing upsizing of the semiconductor device.

According to some embodiments, a semiconductor device used for a liquid discharge head includes a plurality of first heaters configured to give energy to a liquid; a plurality of second heaters, resistance values of which are to be measured; a plurality of switch elements; a first line; and a second line, wherein each of the plurality of second heaters is connected in series with a corresponding one of the plurality of switch elements between the first line and the second line, the plurality of second heaters have a plurality of shapes different in at least one of length in a current flowing direction or width in a direction crossing the current flowing direction, and a connection destination of at least one of two terminals of each of the plurality of first heaters is different from connection destinations of two terminals of each of the second heaters.

Further features of the present invention will become apparent from the following description of exemplary embodiments (with reference to the attached drawings).

BRIEF DESCRIPTION OF THE DRAWINGS

FIGS. 6A to 6D are views for explaining still another embodiment.

DESCRIPTION OF THE EMBODIMENTS

Figure 1:
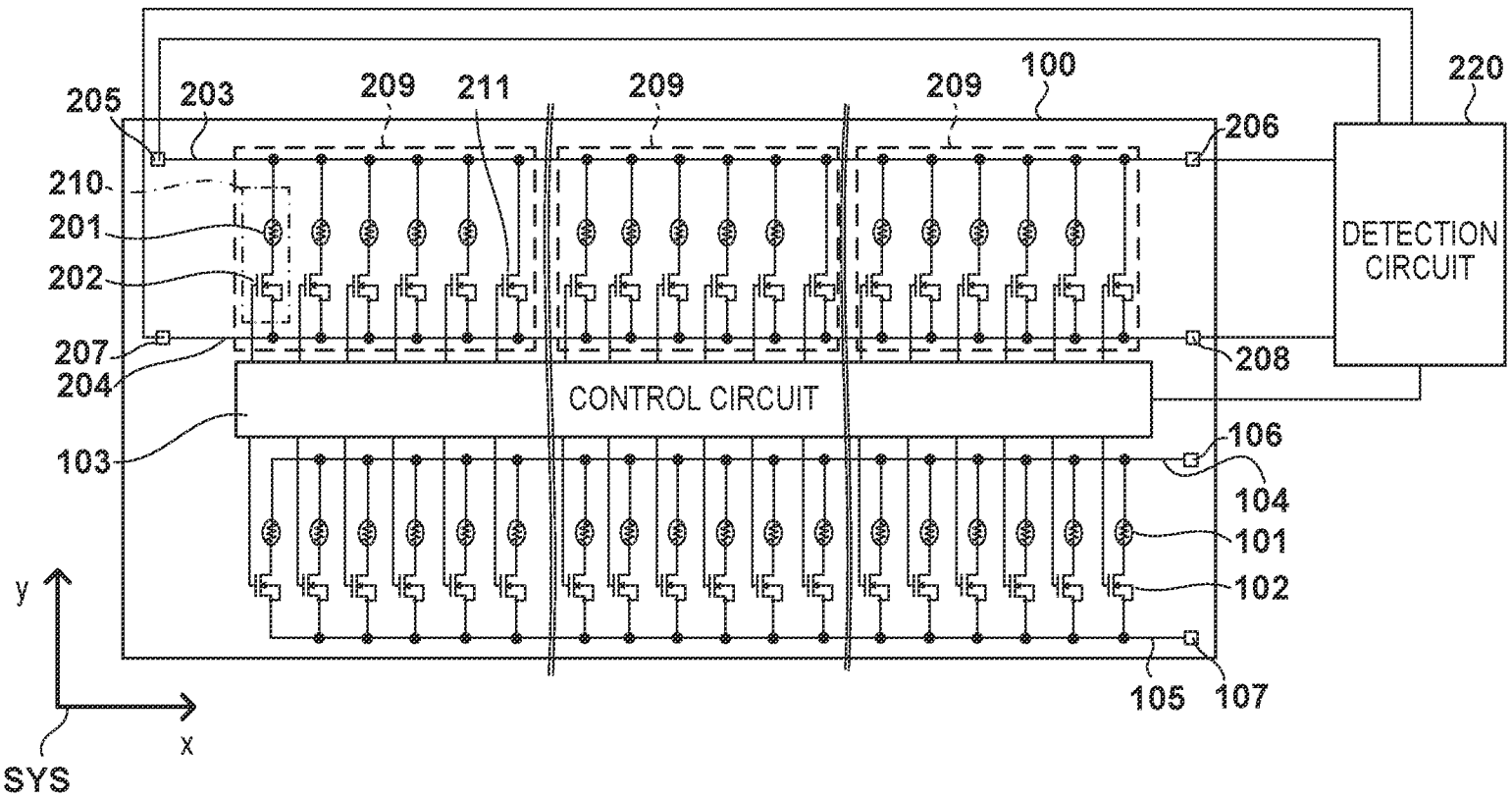
FIG. 1 is a circuit diagram for explaining an example of the arrangement of a semiconductor device according to the first embodiment.

Embodiments of the present invention will be described below with reference to the accompanying drawings. The same reference numerals denote the same elements throughout various embodiments, and a repetitive description thereof will be omitted. The embodiments can appropriately be changed or combined. A semiconductor device to be described below is mounted on a liquid discharge head as a substrate and used for a liquid discharge apparatus such as a copying machine, a facsimile apparatus, a word processor, or the like.

First Embodiment

The arrangement of a semiconductor device 100 will be described with reference to a circuit diagram of FIG. 1. In order to describe directions, a coordinate system SYS along the surface of the semiconductor device 100 is set. In an example below, the coordinate system SYS is a rectangular coordinate system. It is only necessary, however, that two axes (an x-axis and a y-axis) cross each other. An angle formed by the two axes may be, for example, 80° (inclusive) to 90° (exclusive), may be about 60°, or may be about 45°.

The semiconductor device 100 includes a plurality of discharge heaters 101, a plurality of power transistors 102, a control circuit 103, a VH line 104, a GNDH line 105, a VH terminal 106, and a GNDH terminal 107. The semiconductor device 100 further includes a plurality of measurement heaters 201, a plurality of switch elements 202, a common line 203, a common line 204, an Hc terminal 205, an Hp terminal 206, an Lc terminal 207, and an Lp terminal 208.

The discharge heaters 101 are heaters that generate heat in order to give energy to a liquid such as ink. The plurality of discharge heaters 101 are arranged in an x-axis direction. The plurality of discharge heaters 101 may have the same shape. In this embodiment, the same shape indicates shapes whose outlines match when they are superimposed on each other. The power transistors 102 are, for example, n-type power transistors and are arranged in correspondence with the discharge heaters 101. One power transistor 102 is arranged in a y-axis direction with respect to one discharge heater 101. The plurality of power transistors 102 are arranged in the x-axis direction. One end of each discharge heater 101 is connected to the drain of a corresponding one of the power transistors 102. The respective gates of the plurality of power transistors 102 are connected to the control circuit 103.

The VH line 104 extends in the x-axis direction, and one end thereof is connected to the VH terminal 106. A power supply voltage is supplied from the outside of the semiconductor device 100 to the VH terminal 106. One end of each of the plurality of discharge heaters 101 is connected to the VH line 104. The GNDH line 105 extends in the x-axis direction, and one end thereof is connected to the GNDH terminal 107. A ground voltage is supplied from the outside of the semiconductor device 100 to the GNDH terminal 107. The respective sources of the plurality of power transistors 102 are connected to the GNDH line 105.

The measurement heaters 201 are heaters whose resistance values are measured. The plurality of measurement heaters 201 are arranged in the x-axis direction. The switch elements 202 are, for example, n-type power transistors and are arranged in correspondence with the measurement heaters 201. That is, one switch element 202 is arranged in the y-axis direction with respect to one measurement heater 201. The plurality of switch elements 202 are arranged in the x-axis direction. One end of each measurement heater 201 is connected to the drain of a corresponding one of the switch elements 202. The respective gates of the plurality of switch elements 202 are connected to the control circuit 103. The semiconductor device 100 further includes switch elements 211 which do not correspond to the measurement heaters 201. The gates of the switch elements 211 are connected to the control circuit 103.

The common line 203 extends in the x-axis direction, one end thereof is connected to the Hc terminal 205, and one end on an opposite side is connected to the Hp terminal 206. The Hc terminal 205 and the Hp terminal 206 are, for example, pads and are connected to a detection circuit 220 outside the semiconductor device 100. One end of each of the plurality of measurement heaters 201 is connected to the common line 203. The common line 204 extends in the x-axis direction, one end thereof is connected to the Lc terminal 207, and one end on an opposite side is connected to the Lp terminal 208. The Lc terminal 207 and the Lp terminal 208 are, for example, pads and are connected to the detection circuit 220 outside the semiconductor device 100. The respective sources of the plurality of switch elements 202 are connected to the common line 204. The switch elements 211 are connected between the common line 203 and the common line 204 without going through the heaters. More specifically, the drains of the switch elements 211 are directly connected to the common line 203 without going through the measurement heaters 201.

A circuit formed by one measurement heater 201 and one switch element 202 corresponding to this will be referred to as a unit 210. Each circuit formed by a plurality of the units 210 and the switch element 211 will be referred to as a unit 209. In the semiconductor device 100, the plurality of units 209 are arranged in the x-axis direction. Thus, each of the plurality of measurement heaters 201 is connected in series with the corresponding one of the plurality of switch elements 202 between the common line 203 and the common line 204. The plurality of discharge heaters 101 are connected to neither the common line 203 nor the common line 204. Instead of this, the plurality of discharge heaters 101 may not be connected to at least one of the common line 203 and the common line 204. For example, the plurality of discharge heaters 101 may be connected to the common line 204 without being connected to the common line 203 or may be connected to the common line 203 without being connected to the common line 204. In other words, a connection destination of at least one of two terminals of each of the plurality of discharge heaters 101 may be different from a connection destination of two terminals of a corresponding one of the measurement heaters 201.

The control circuit 103 controls ON/OFF of the power transistors 102 in accordance with a signal (not shown) from the outside. The control circuit 103 also controls ON/OFF of the switch elements 202 in accordance with a signal (not shown) from the outside. The control circuit 103 is formed by, for example, a shift register, a decoder, or the like. The control circuit 103 may include a shared portion between a circuit arrangement for controlling ON/OFF of the plurality of switch elements 202 and a circuit arrangement for controlling ON/OFF of the plurality of power transistors 102. For example, a signal line for selecting the power transistors 102 and the switch elements 202 may be commonized, and a selection between the power transistors 102 and the switch elements 202 may be controlled in accordance with a selection signal. By thus commonizing the circuit arrangements, it is possible to suppress an increase in chip size.

Figure 2:
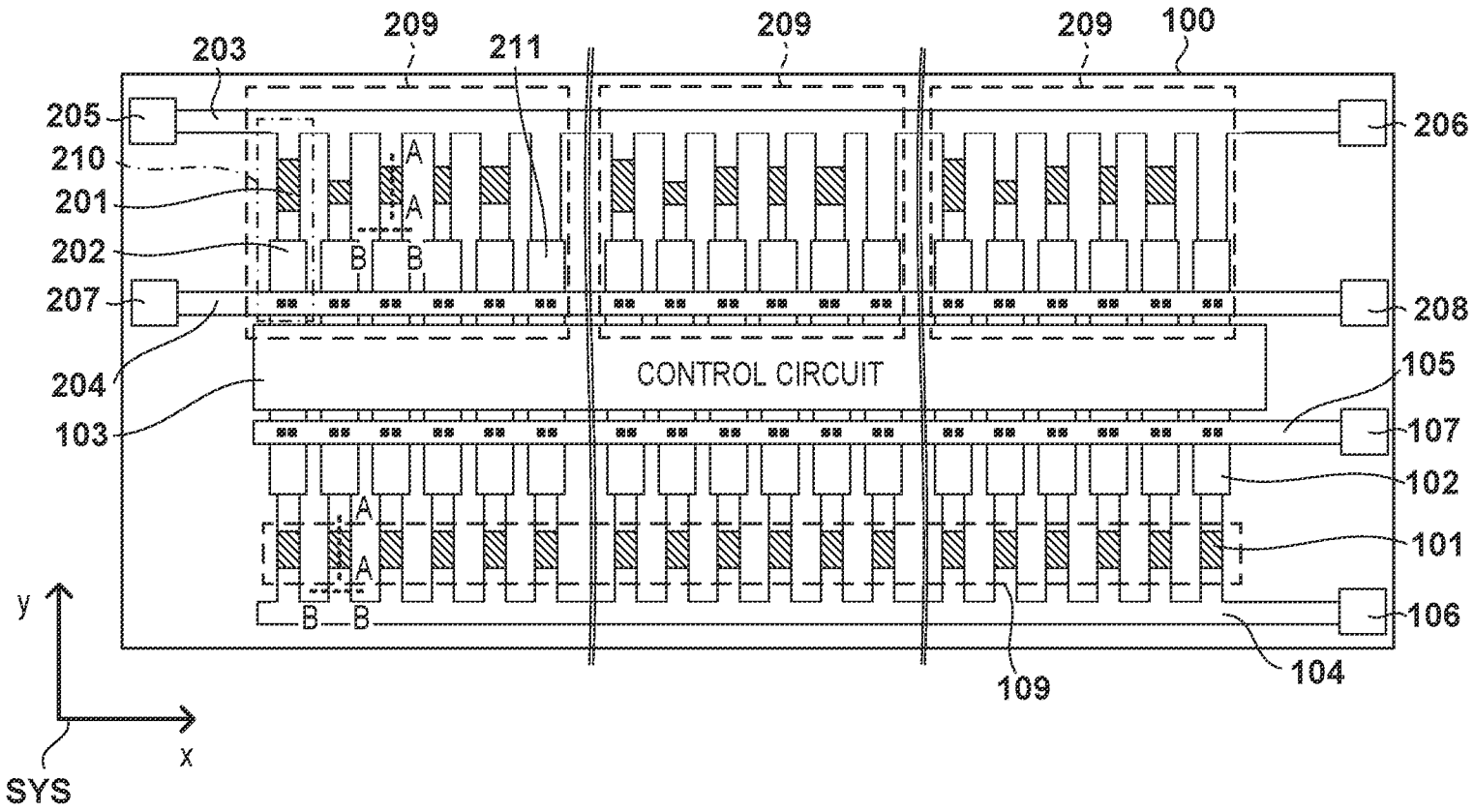
FIG. 2 is a layout diagram for explaining an example of the arrangement of the semiconductor device according to the first embodiment.

The layout of the semiconductor device 100 will be described next with reference to FIG. 2. The plurality of discharge heaters 101 are arranged side by side in a region 109. The region 109 and the plurality of units 209 are located on opposite sides with respect to the control circuit 103. That is, the plurality of measurement heaters 201 are located in the y-axis direction with respect to the region 109. The plurality of measurement heaters 201 may include heaters located in the y-axis direction with respect to the center portion of the region 109 and heaters located in the y-axis direction with respect to the end portions of the region 109. While orifices are arranged with respect to the discharge heaters 101, orifices are not arranged with respect to the measurement heaters 201. In other words, while each discharge heater 101 has a function of discharging a liquid, each measurement heater 201 does not have a function of discharging a liquid.

The plurality of measurement heaters 201 included in the same unit 209 have a plurality of shapes different in at least one of length in a current flowing direction (x-axis direction) (to be simply referred to as a length hereinafter) and width in a direction crossing the current flowing direction (y-axis direction) (to be simply referred to as a width hereinafter). In an example, the dimensions (for example, the lengths or the widths) of two objects are different if a difference in dimension of both the objects is 10% or more of the dimension of one of the objects. The plurality of measurement heaters 201 included in each unit 209 may include the measurement heater 201 equal both in length and width to one of the plurality of discharge heaters 101. In an example, the dimensions (for example, the lengths or the widths) of two objects are equal if a difference in dimension of both the objects is 5% or less of the dimension of one of the objects. The plurality of measurement heaters 201 may include a heater having a width and a length equal to each other.

A manufacturing step of the heater 101 and the heater 201 of a method of manufacturing the semiconductor device 100 will be described with reference to FIGS. 3A to 3F. The manufacturing step below is an example, and the heater 101 and the heater 201 may be formed in another step. The left side of each of FIGS. 3A to 3F indicates sections each taken along a line A-A in FIG. 2, that is, positions corresponding to a section in the length direction (y-axis direction) of each of the heater 101 and the measurement heater 201. The right side of each of FIGS. 3A to 3F indicates sections each taken along a line B-B in FIG. 2, that is, positions corresponding to a section in the width direction (x-axis direction) of each of the heater 101 and the measurement heater 201. FIG. 2 includes the lines A-A in two portions, and both of them are manufactured in the same section. Similarly, FIG. 2 includes the lines B-B in two portions, and both of them are manufactured in the same section.

Figure 3A:
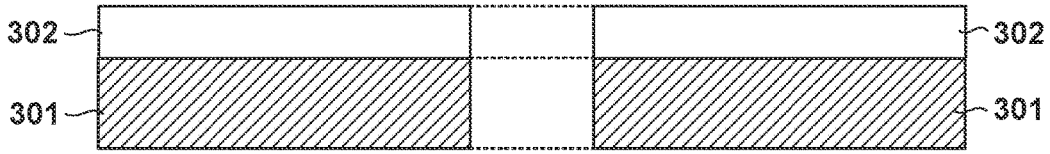
FIGS. 3A to 3F are circuit diagrams for explaining an example of a method of manufacturing the semiconductor device according to the first embodiment.
Figure 3B:
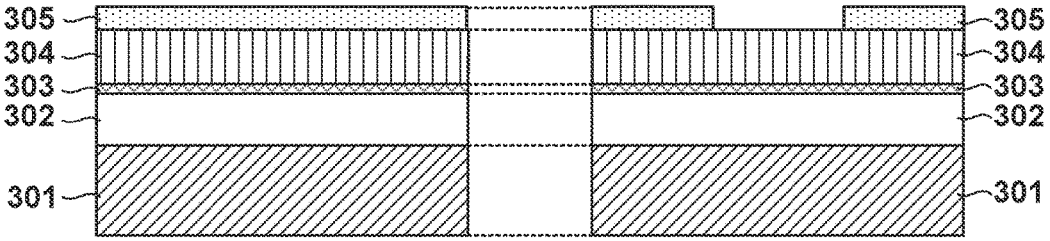

First, as shown in FIG. 3A, a substrate 301 which is formed by a semiconductor such as silicon or the like and on which an element (not shown) such as a MOS transistor has been formed is prepared, and an insulating film 302 is formed on this substrate 301. Next, as shown in FIG. 3B, a heating resistor layer 303 for forming heaters and a wiring layer 304 for forming lines are formed on the insulating film 302, and a mask pattern 305 for patterning is formed.

Figure 3C:
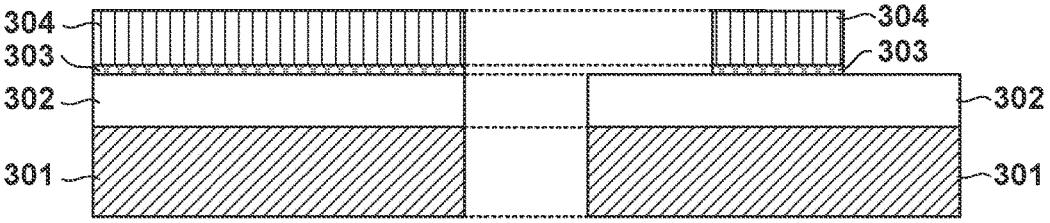
Figure 3D:
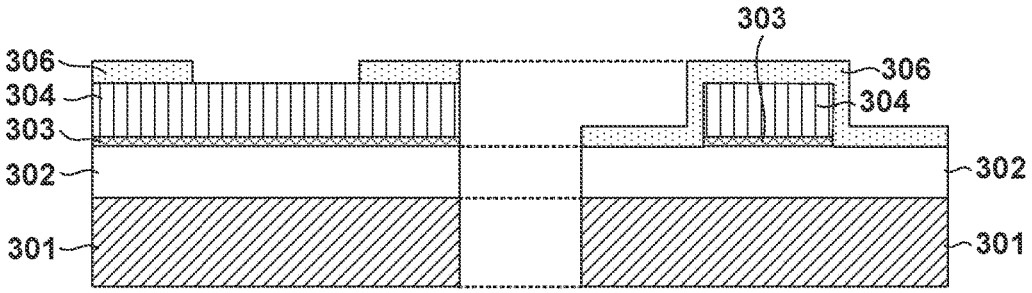

Subsequently, as shown in FIG. 3C, patterning is performed by using the mask pattern 305. This patterning is performed by, for example, anisotropic etching such as RIE (Reactive Ion Etching). If patterning is performed by anisotropic etching, the side surfaces of the wiring layer 304 become almost vertical. Patterning may be performed by another method, and the side surfaces of the wiring layer 304 may have inclined surfaces. Next, as shown in FIG. 3D, a mask pattern 306 having an opening on a portion of the heating resistor layer 303 that should function as the heater is formed.

Figure 3E:
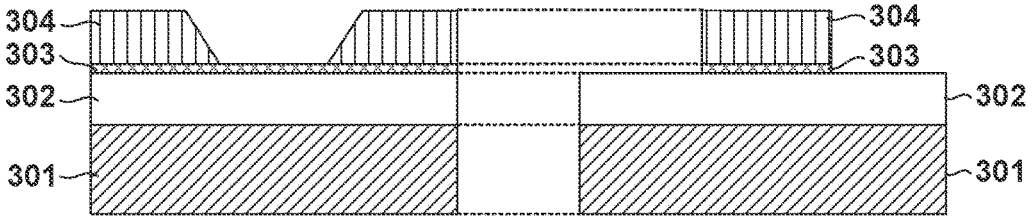
Figure 3F:
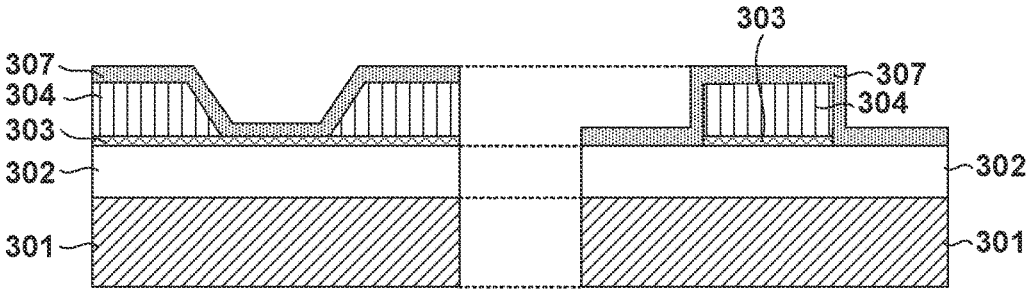

Subsequently, as shown in FIG. 3E, isotropic etching such as wet etching or the like is performed by using the mask pattern 308. In this step, portions of the heating resistor layer 303 which are not covered with the wiring layer 304 become the heaters 101 and the heaters 201. Portions of the wiring layer 304 which are not removed become the lines. For example, when a diagram on the left side of FIG. 3E represents the heater 101, one portion of the wiring layer 304 divided into two is connected to the VH line 104, and the other portion is connected to the power transistor 102. When the diagram on the left side of FIG. 3E represents the heater 201, one portion of the wiring layer 304 divided into two is connected to the common line 203, and the other portion is connected to the switch element 202. Subsequently, as shown in FIG. 3F, a protection layer 307 of silicon nitride or the like is formed so as to cover the entire surfaces of the heater 101, heater 201, and lines.

As described above, the discharge heater 101 and the measurement heater 201 are formed in the same step. Therefore, the plurality of discharge heaters 101 and the plurality of measurement heaters 201 are formed in the same layer with the same material.

A method of measuring the resistance values of the measurement heaters 201 will now be described. The detection circuit 220 measures the resistance values. In FIG. 1, the detection circuit 220 may be mounted on the liquid discharge head or the liquid discharge apparatus where the semiconductor device 100 is mounted. Instead of this, the detection circuit 220 may form a part of the semiconductor device 100. In a description below, the plurality of switch elements 202 included in one unit 209 have the same ON resistance as the switch element 211 included in the same unit 209. The method of measuring the resistance values of the plurality of measurement heaters 201 included in one unit 209 will be described below. However, measurement is performed in the same manner for the other units 209.

By transmitting a control signal to the control circuit 103, the detection circuit 220 turns off all the plurality of switch elements 202 and turns on the switch elements 211. In this state, the detection circuit 220 inputs a current to the Hc terminal 205 and outputs a current from the Lc terminal 207. The detection circuit 220 measures a voltage between the Hp terminal 206 and the Lp terminal 208 at this time. The detection circuit 220 calculates ON resistances of the switch elements 211 based on these values.

Subsequently, by transmitting a control signal to the control circuit 103, the detection circuit 220 turns on one of the plurality of switch elements 202 to be measured, and turns off the other switch elements 202 and the switch elements 211. In this state, the detection circuit 220 inputs a current to the Hc terminal 205 and outputs a current from the Lc terminal 207. The detection circuit 220 measures a voltage between the Hp terminal 206 and the Lp terminal 208 at this time. Based on these values, the detection circuit 220 calculates the resistance value of each unit 210 in which the measurement heater 201 and the switch element 202 are connected directly. The detection circuit 220 subtracts the ON resistance of the switch element 211 from the resistance value of the unit 210. The ON resistance of the switch element 202 and the ON resistance of the switch element 211 are equal to each other. Therefore, the resistance value of the measurement heater 201 is calculated by this subtraction.

In the above-described calculation method, the detection circuit 220 measures the resistance values by using each of the Hc terminal 205, Hp terminal 206, Lc terminal 207, and Lp terminal 208. With such measurement using the four terminals, it is possible to reduce an influence by a parasitic resistance of lines inside and outside the semiconductor device 100. Instead of this, the detection circuit 220 may measure a resistance value by using only the Hc terminal 205 and the Lc terminal 207. In this case, the Hp terminal 206 and the Lp terminal 208 need not be arranged, making it possible to further downsize the semiconductor device 100. Furthermore, in the above-described calculation method, the detection circuit 220 measures a voltage generated in accordance with supply of a current between two terminals. Instead of this, however, the detection circuit 220 may measure a current generated in accordance with application of a voltage between two terminals.

A method of estimating a manufacturing error in the plurality of discharge heaters 101 will now be described. Because of an error in the manufacture, it is difficult to create each of the discharge heaters 101 formed by the above-described step to have a shape as designed. In addition, there is a variation in error between the respective heaters. As a factor of this variation, the pattern accuracy of a mask pattern or processing accuracy at the time of etching is given. Moreover, there is a variation in thickness of the heating resistor layer 303 that forms the discharge heater 101 and the measurement heater 201 depending on a position in the semiconductor device 100. Furthermore, even a heater of a rectangle from the viewpoint of design may have, in practice, four rounded corners or an arcuate shape that was originally a linear shape.

In this embodiment, based on the resistance values of the plurality of measurement heaters 201 measured by the above-described measurement method, the detection circuit 220 estimates a power density provided by each of the plurality of discharge heaters 101. This estimation may be performed by extending, for example, a computation expression described in U.S. Pat. No. 8,439,477 to a multivariable system. Instead of this, estimation may be performed by using a result of machine learning. For example, the plurality of sampling semiconductor devices 100 designed to have the same shape are prepared. Regarding the respective semiconductor devices 100, the respective resistance values of the plurality of measurement heaters 201 are measured, and the respective power densities of the plurality of discharge heaters 101 are estimated from a discharge result using these semiconductor devices 100. Subsequently, machine learning that uses the combination of the respective measured resistance values of the plurality of measurement heaters 201 and the respective power densities of the plurality of discharge heaters 101 as supervisory data is performed. This estimates a function with the respective resistance values of the plurality of measurement heaters 201 as an input and the respective power densities of the plurality of discharge heaters 101 as an output. Subsequently, in an actual product, the detection circuit 220 estimates the respective power densities of the plurality of discharge heaters 101 by applying the respective measured resistance values of the plurality of measurement heaters 201 to this function. In this machine learning, the respective power densities of the plurality of discharge heaters 101 are used as the output. Instead of this, however, the respective shapes of the plurality of discharge heaters 101 may be used as an output.

In this embodiment, estimation accuracy of the shapes of the discharge heaters 101 is improved as the number of measurement heaters 201 is larger. Thus, the number of measurement heaters 201 may be, for example, 25% or more, 50% or more, 75% or more, or 90% or more of the number of discharge heaters 101. On the other hand, if the number of measurement heaters 201 is large, the size of the semiconductor device 100 also increases accordingly. Therefore, the number of measurement heaters 201 may be 100% or less, 90% or less, or 75% or less of the number of discharge heaters 101.

Based on the estimated power densities (or shapes) of the plurality of discharge heaters 101, the liquid discharge apparatus that mounts the semiconductor device 100 adjusts a parameter for controlling each power transistor 102 by the control circuit 103. As such a parameter, the length of a period in which the power transistor 102 is ON, a voltage applied to the gate of the power transistor 102, or the like is included. Instead of this or in addition to this, the liquid discharge apparatus that includes the semiconductor device 100 may control a voltage value applied to the VH terminal 106 or may perform another control.

By using the semiconductor device 100 of this embodiment, it becomes possible to estimate the shape of each discharge heater 101 accurately while suppressing the increase in chip size. As a result, it is possible to provide a liquid discharge head having accurate discharge performance.

Second Embodiment

Figure 4:
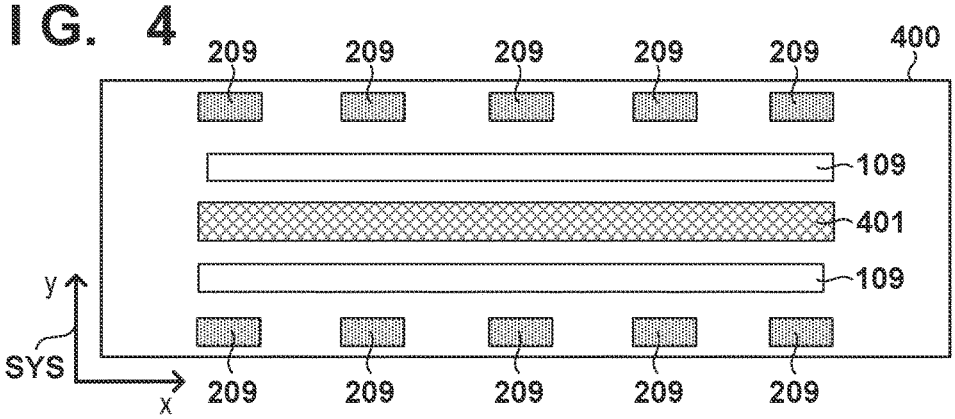
FIG. 4 is a layout diagram for explaining an example of the arrangement of a semiconductor device according to the second embodiment.

A semiconductor device 400 according to the second embodiment will be described with reference to FIG. 4. A difference from the semiconductor device 100 of the first embodiment will mainly be described, and a description of an arrangement which may be the same will be omitted. The semiconductor device 400 includes a plurality of (two in this example) regions 109 in which a plurality of discharge heaters 101 are arranged. The semiconductor device 400 can discharge ink at a twofold density by including two columns of the plurality of discharge heaters 101.

These two regions 109 are arranged in a y-axis direction, and a liquid supply port 401 is located between them. The liquid supply port 401 is a through hole for supplying a liquid. A plurality of units 209 are arranged on a positive side in the y-axis direction with respect to the upper region 109. The plurality of units 209 are arranged on a negative side in the y-axis direction with respect to the lower region 109. By thus arranging the units 209, it is possible to accurately estimate the shapes of the discharge heaters 101 arranged in the plurality of regions 109.

Third Embodiment

Figure 5:
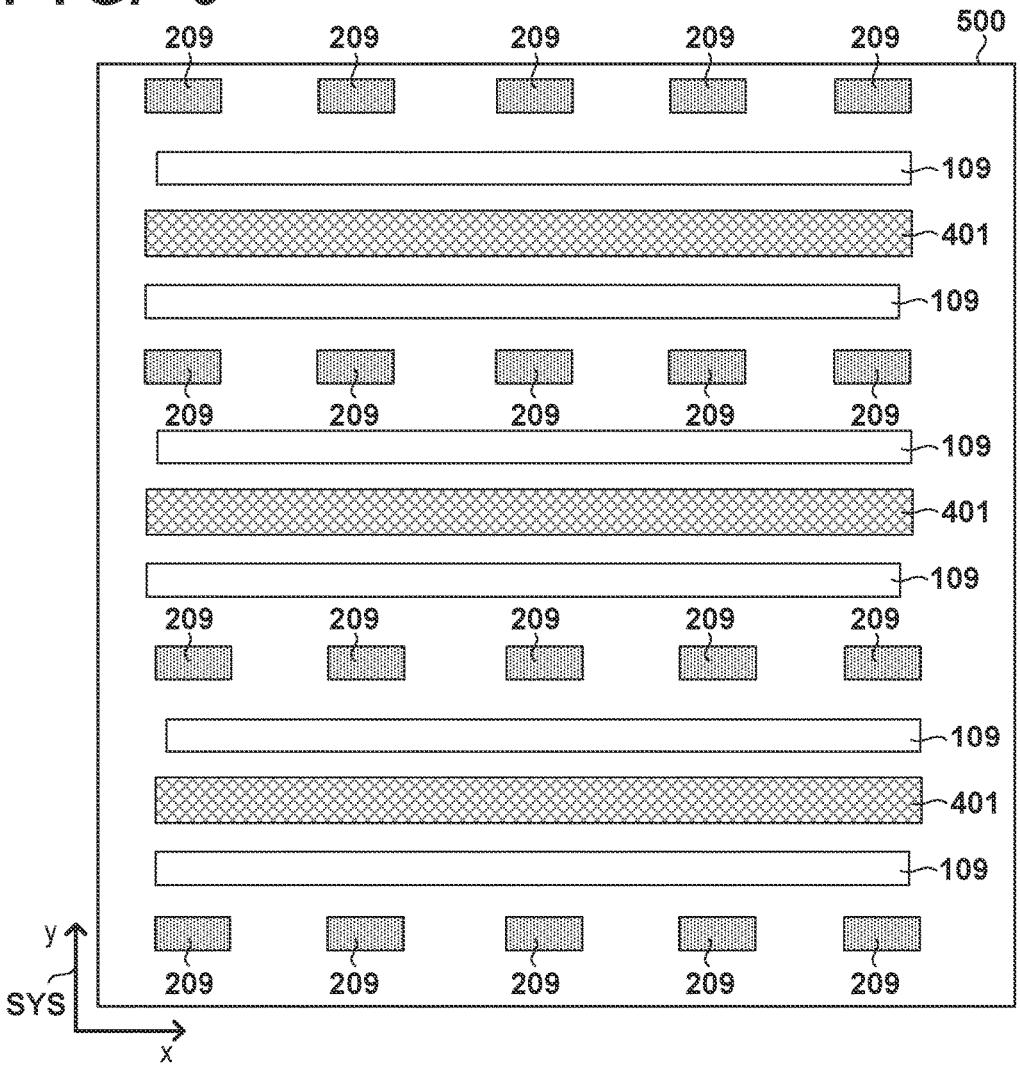
FIG. 5 is a layout diagram for explaining an example of the arrangement of a semiconductor device according to the third embodiment.

A semiconductor device 500 according to the third embodiment will be described with reference to FIG. 5. A difference from the semiconductor device 100 of the first embodiment will mainly be described, and a description of an arrangement which may be the same will be omitted. The semiconductor device 500 includes a plurality of (six in this example) regions 109 in which a plurality of discharge heaters 101 are arranged. Liquid supply ports 401 are arranged between the regions 109 of the first column and the second column from the top, between the regions 109 of the third column and the fourth column, and between the regions 109 of the fifth column and the sixth column. Liquids different in color may be supplied to these three liquid supply ports 401, and the discharge heater 101 of each column may have a shape corresponding to a color.

A plurality of units 209 arranged in an x-axis direction are arranged on a positive side of the region 109 of the first column in a y-axis direction, between the regions 109 of the second column and the third column, between the regions 109 of the fourth column and the fifth column, and on a negative side of the region 109 of the sixth column in the y-axis direction, respectively. The plurality of units 209 arranged between the regions 109 of the second column and the third column may be used to estimate both the shapes of the discharge heaters 101 included in the region 109 of the second column and the discharge heaters 101 included in the region 109 of the third column. In these units 209, measurement heaters 201 having shapes according to the discharge heaters 101 corresponding to various colors may coexist.

By thus arranging the units 209, it is possible to accurately estimate the shapes of the discharge heaters 101 for the respective colors arranged in the plurality of regions 109, respectively.

Still Another Embodiment

FIG. 6A exemplifies the internal arrangement of a liquid discharge apparatus 1600 typified by an inkjet printer, a facsimile apparatus, a copy machine, or the like. In this example, the liquid discharge apparatus may be referred to as a printing apparatus. The liquid discharge apparatus 1600 includes a liquid discharge head 1510 that discharges a liquid (ink or a printing material in this example) to a predetermined medium P (a printing medium such as paper in this example). In this example, the liquid discharge head may be referred to as a printhead. The liquid discharge head 1510 is mounted on a carriage 1620, and the carriage 1620 can be attached to a lead screw 1621 having a helical groove 1604. The lead screw 1621 can rotate in synchronism with rotation of a driving motor 1601 via driving force transfer gears 1602 and 1603. Along with this, the liquid discharge head 1510 can move in a direction indicated by an arrow a or b along a guide 1619 together with the carriage 1620.

The medium P is pressed by a paper press plate 1605 in the carriage moving direction and is fixed to a platen 1606. The liquid discharge apparatus 1600 reciprocates the liquid discharge head 1510 and performs liquid discharge (printing in this example) on the medium P conveyed on the platen 1606 by a conveyance unit (not shown).

The liquid discharge apparatus 1600 confirms the position of a lever 1609 provided on the carriage 1620 via photocouplers 1607 and 1608, and switches the rotational direction of the driving motor 1601. A support member 1610 supports a cap member 1611 for covering the nozzles (liquid orifices or simply orifices) of the liquid discharge head 1510. A suction unit 1612 performs recovery processing of the liquid discharge head 1510 by sucking the interior of the cap member 1611 via an intra-cap opening 1613. A lever 1617 is provided to start recovery processing by suction, and moves along with movement of a cam 1618 engaged with the carriage 1620. A driving force from the driving motor 1601 is controlled by a well-known transfer mechanism such as clutch switching.

A main body support plate 1616 supports a moving member 1615 and a cleaning blade 1614. The moving member 1615 moves the cleaning blade 1614, and performs recovery processing of the liquid discharge head 1510 by wiping. A control unit (not shown) is also provided in the liquid discharge apparatus 1600, and controls driving of each mechanism described above.

FIG. 6B exemplifies the outer appearance of the liquid discharge head 1510. The liquid discharge head 1510 can include a head unit 1511 including a plurality of nozzles 1500, and a tank (liquid containing unit) 1512 that holds a liquid to be supplied to the head unit 1511. The tank 1512 and the head unit 1511 can be isolated at, for example, a broken line K, and the tank 1512 can be changed. The liquid discharge head 1510 includes an electrical contact (not shown) for receiving an electrical signal from the carriage 1620, and discharges a liquid in accordance with the electrical signal. The tank 1512 includes, for example, a fibrous or porous liquid holding member (not shown), and can hold a liquid by the liquid holding member.

FIG. 6C exemplifies the internal arrangement of the liquid discharge head 1510. The liquid discharge head 1510 includes a base 1508, channel wall members 1501 that are arranged on the base 1508 and form channels 1505, and a top plate 1502 having a liquid supply path 1503. The substrate 1508 may be one of the above-described semiconductor devices 100, 400, and 500. As discharge elements or liquid discharge elements, heaters 1506 (electrothermal transducers) are arrayed on the substrate (liquid discharge head substrate) of the printhead 1510 in correspondence with the respective nozzles 1500. When a driving element (switching element such as a transistor) provided in correspondence with each heater 1506 is turned on, the heater 1506 is driven to generate heat.

A liquid from the liquid supply path 1503 is stored in a common liquid chamber 1504, and supplied to each nozzle 1500 through the corresponding channel 1505. The liquid supplied to each nozzle 1500 is discharged from the nozzle 1500 in response to driving of the heater 1506 corresponding to the nozzle 1500.

Figure 6D:
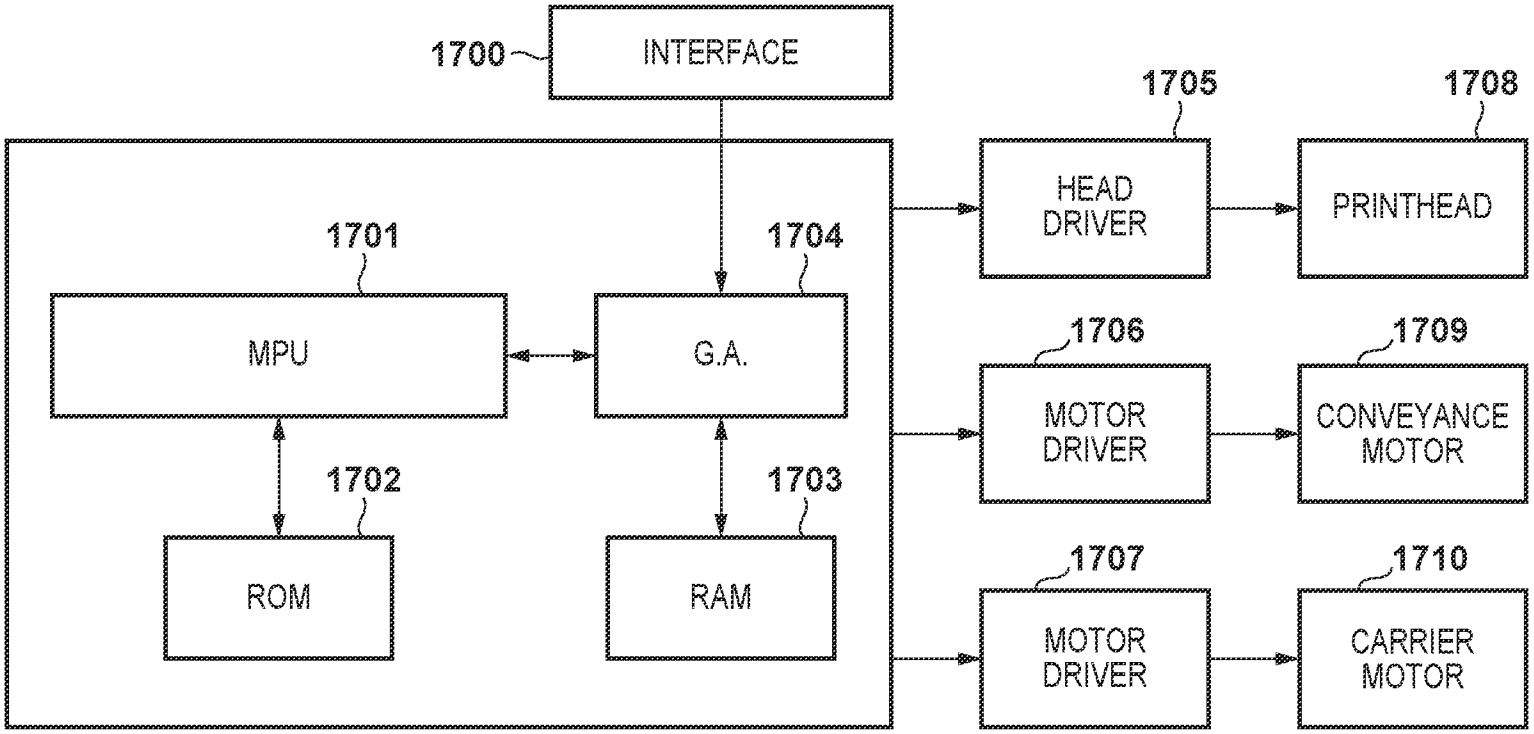

FIG. 6D exemplifies the system arrangement of the liquid discharge apparatus 1600. The liquid discharge apparatus 1600 includes an interface 1700, an MPU 1701, a ROM 1702, a RAM 1703, and a gate array (G.A.) 1704. The interface 1700 receives an external signal for performing liquid discharge from the outside. The ROM 1702 stores a control program to be executed by the MPU 1701. The RAM 1703 saves various signals and data such as the above-mentioned liquid discharge external signal and data supplied to a liquid discharge head 1708. The gate array 1704 performs supply control of data to the liquid discharge head 1708, and controls data transfer between the interface 1700, the MPU 1701, and the RAM 1703.

The liquid discharge apparatus 1600 further includes a head driver 1705, motor drivers 1706 and 1707, a conveyance motor 1709, and a carrier motor 1710. The carrier motor 1710 conveys the liquid discharge head 1708. The conveyance motor 1709 conveys the medium P. The head driver 1705 drives the liquid discharge head 1708. The motor drivers 1706 and 1707 drive the conveyance motor 1709 and the carrier motor 1710, respectively.

When a driving signal is input to the interface 1700, it can be converted into liquid discharge data between the gate array 1704 and the MPU 1701. Each mechanism performs a desired operation in accordance with this data, thus driving the liquid discharge head 1708.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-117888, filed Jun. 15, 2017, which is hereby incorporated by reference herein in its entirety.

What is claimed is:

1. A semiconductor device used for a liquid discharge head, the device comprising:

a plurality of first heaters configured to apply energy to a liquid;

a plurality of second heaters whose resistance values are to be measured;

a plurality of switch elements;

a first line; and a second line, wherein each of the plurality of second heaters is connected in series with a corresponding one of the plurality of switch elements between the first line and the second line, the plurality of second heaters have a plurality of shapes different in at least one of length in a current flowing direction or width in a direction crossing the current flowing direction, and a connection destination of at least one of two terminals of each of the plurality of first heaters is different from connection destinations of two terminals of each of the second heaters.

2. The device according to claim 1, wherein the plurality of first heaters and the plurality of second heaters are formed in the same layer.

3. The device according to claim 1, wherein the plurality of second heaters include a heater equal in one of length and width to one of the plurality of first heaters.

4. The device according to claim 1, further comprising:

a first terminal connected to one end of the first line; and a second terminal connected to one end of the second line, wherein resistance values of the plurality of second heaters are measured by measuring one of a voltage and a current between the first terminal and the second terminal.

5. The device according to claim 4, further comprising:

a third terminal connected to a side opposite to the first terminal of the first line; and a fourth terminal connected to a side opposite to the second terminal of the second line, wherein resistance values of the plurality of second heaters are measured by further measuring one of a voltage and a current between the third terminal and the fourth terminal.

6. The device according to claim 1, further comprising a switch element connected between the first line and the second line without going through a heater.

7. The device according to claim 1, further comprising:

a plurality of power transistors connected to the plurality of first heaters; and a control circuit configured to control ON/OFF of the plurality of switch elements and ON/OFF of the plurality of power transistors, wherein the control circuit includes a shared portion between a circuit arrangement for controlling ON/OFF of the plurality of switch elements and a circuit arrangement for controlling ON/OFF of the plurality of power transistors.

8. The device according to claim 1, wherein orifices are arranged with respect to the plurality of first heaters, and orifices are not arranged with respect to the plurality of second heaters.

9. The device according to claim 1, wherein the plurality of switch elements are connected to a common line, which is one of the first line and the second line, and terminals, of the plurality of second heaters, which are not terminals connected to the switch elements, are connected to pads different from pads to which the plurality of first heaters are connected.

10. The device according to claim 1, wherein the plurality of second heaters include a heater having a width and a length equal to each other.

11. The device according to claim 1, wherein the first heaters are discharge heaters, and the second heaters are measurement heaters.

12. A semiconductor device used for a liquid discharge head, the device comprising:

a plurality of first heaters configured to apply energy to a liquid;

a plurality of second heaters whose resistance values are to be measured;

a plurality of switch elements;

a first line; and a second line, wherein each of the plurality of second heaters is connected in series with a corresponding one of the plurality of switch elements between the first line and the second line, the plurality of second heaters have a plurality of shapes different in at least one of width or length, the plurality of first heaters are arranged in a first direction, the plurality of second heaters are arranged in the first direction, and the plurality of second heaters are located in a second direction crossing the first direction with respect to a region where the plurality of first heaters are arranged.

13. The device according to claim 12, wherein the plurality of second heaters include a heater located in the second direction with respect to a center portion of the region where the plurality of first heaters are arranged.

14. The device according to claim 12, wherein the plurality of second heaters include a heater located in the second direction with respect to an end portion of the region where the plurality of first heaters are arranged.

15. A semiconductor device used for a liquid discharge head, the device comprising:

a plurality of first heaters configured to apply energy to a liquid;

a plurality of second heaters whose resistance values are to be measured;

a plurality of switch elements;

a first line; and a second line, wherein each of the plurality of second heaters is connected in series with a corresponding one of the plurality of switch elements between the first line and the second line, the plurality of second heaters have a plurality of shapes different in at least one of width or length, and the plurality of second heaters include a heater different from one of the plurality of first heaters at least in one of width and length by not less than 10% of that of the one of the plurality of first heaters.

16. A liquid discharge head comprising:

a semiconductor device defined in claim 1; and orifices whose liquid discharge is controlled by the semiconductor device.

17. A liquid discharge apparatus comprising:

a liquid discharge head defined in claim 16; and a supply unit configured to supply a driving signal for discharging the liquid to the liquid discharge head.

18. The apparatus according to claim 17, further comprising a detection circuit configured to measure one of a voltage and a current between a first terminal connected to one end of the first line and a second terminal connected to one end of the second line, and calculate resistance values of the plurality of second heaters based on a measurement result.

* * * * *